US006647715B2

(12) United States Patent
Farkas

(10) Patent No.: US 6,647,715 B2
(45) Date of Patent: Nov. 18, 2003

(54) HEAT SHIELD FOR AN EXHAUST SYSTEM OF AN INTERNAL COMBUSTION ENGINE

(75) Inventor: Kornel Farkas, Richmond Hill (CA)

(73) Assignee: Van-Rob Stampings Inc., Aurora (CA)

( * ) Notice: Subject to any disclaimer, the term of this patent is extended or adjusted under 35 U.S.C. 154(b) by 0 days.

(21) Appl. No.: 09/996,895

(22) Filed: Nov. 30, 2001

(65) Prior Publication Data

US 2003/0101719 A1 Jun. 5, 2003

(51) Int. Cl.[7] ..... F01N 7/10
(52) U.S. Cl. ..... 60/323; 60/322
(58) Field of Search ..... 60/272, 322, 313, 60/323; 181/240

(56) References Cited

U.S. PATENT DOCUMENTS

| | | | | | |
|---|---|---|---|---|---|
| 4,612,767 | A | | 9/1986 | Engquist et al. | |
| 4,851,271 | A | | 7/1989 | Moore, III et al. | |
| 4,952,610 | A | | 8/1990 | Moore, III et al. | |
| 5,030,518 | A | | 7/1991 | Keller | |
| 5,080,949 | A | | 1/1992 | Nawrocki et al. | |
| 5,108,817 | A | | 4/1992 | Kidd et al. | |
| 5,143,755 | A | | 9/1992 | Moore, III et al. | |
| 5,167,060 | A | | 12/1992 | Nawrocki et al. | |
| 5,196,206 | A | | 3/1993 | Troia et al. | |
| 5,196,253 | A | | 3/1993 | Mueller et al. | |
| 5,233,832 | A | * | 8/1993 | Moore, III | 60/323 |
| 5,271,142 | A | | 12/1993 | Moore, III et al. | |
| 5,290,904 | A | | 3/1994 | Colvin et al. | |
| 5,347,810 | A | | 9/1994 | Moore, III et al. | |
| 5,385,790 | A | | 1/1995 | Atkinson et al. | |
| 5,419,127 | A | * | 5/1995 | Moore, III | 60/322 |
| D366,110 | S | | 1/1996 | Darr | |
| 5,550,338 | A | | 8/1996 | Hielscher | |
| 5,555,932 | A | | 9/1996 | Dudley | |
| 5,590,524 | A | * | 1/1997 | Moore et al. | 60/323 |
| 5,603,297 | A | | 2/1997 | Wolf et al. | |
| 5,656,353 | A | | 8/1997 | Butler | |
| 5,670,264 | A | | 9/1997 | Sheridan | |
| 5,680,757 | A | | 10/1997 | Pirchl | |
| 5,800,905 | A | * | 9/1998 | Sheridan et al. | 60/323 |
| 5,816,043 | A | | 10/1998 | Wolf et al. | |
| 5,844,177 | A | | 12/1998 | Pirchl | |
| 5,846,634 | A | | 12/1998 | Werth et al. | |
| 5,901,428 | A | | 5/1999 | Sheridan | |
| 5,915,283 | A | | 6/1999 | Reed et al. | |
| 5,939,212 | A | | 8/1999 | Ragland et al. | |
| 5,958,603 | A | | 9/1999 | Ragland | |
| 5,968,306 | A | | 10/1999 | Kleinhenz et al. | |
| 5,974,784 | A | * | 11/1999 | Feldman | 60/272 |
| 5,981,082 | A | * | 11/1999 | Pirchl | 428/603 |
| 5,996,730 | A | | 12/1999 | Pirchl | |
| 6,012,493 | A | | 1/2000 | Remke | |
| 6,026,846 | A | | 2/2000 | Wolf et al. | |
| 6,071,370 | A | | 6/2000 | Stiles | |
| 6,131,252 | A | | 10/2000 | Hoheisel et al. | |
| 6,177,157 | B1 | | 1/2001 | Cota | |
| 6,207,293 | B1 | | 3/2001 | Ragland et al. | |
| 6,207,299 | B1 | | 3/2001 | Krauth et al. | |
| 6,231,944 | B1 | | 5/2001 | Holt | |
| 6,233,808 | B1 | | 5/2001 | Cota | |
| 6,276,044 | B1 | * | 8/2001 | Ragland et al. | 267/43 |
| 6,349,542 | B1 | * | 2/2002 | Moore, III | 60/323 |
| 6,391,469 | B1 | * | 5/2002 | Ragland et al. | 428/593 |
| 6,451,447 | B1 | | 9/2002 | Ragland | |
| 6,555,070 | B1 | * | 4/2003 | Kruger | 422/179 |
| 2002/0150742 | A1 | | 10/2002 | Ragland | |

* cited by examiner

*Primary Examiner*—Thomas Denion
*Assistant Examiner*—Diem T Tran
(74) *Attorney, Agent, or Firm*—Riches, McKenzie & Herbert LLP

(57) ABSTRACT

The present invention provides a heat shield for an exhaust system of an internal combustion engine. The shield comprises three metal layers shaped to conform generally to the shape of a high temperature portion of said exhaust system; said metal layers having substantially the same shape and extending in face-to-face adjacency with one layer positioned between the other two layers; all three metal layers being substantially identical.

15 Claims, 3 Drawing Sheets

HEAT SHIELD FOR AN EXHAUST SYSTEM OF AN INTERNAL COMBUSTION ENGINE

SCOPE OF THE INVENTION

This invention relates to a heat shield with thermal, acoustical and/or vibrational abatement properties and, in particular, to a heat shield for an exhaust system of an internal combustion engine.

BACKGROUND OF THE INVENTION

Heat shields for exhaust systems of internal combustion engines are known, for example, as described in U.S. Pat. No. 5,590,524 to Moore et al. issued Jan. 7, 1997, U.S. Pat. No. 6,177,157 to Cota issued Jan. 23, 2001, and U.S. Pat. No. 6,231,944 to Holt issued May 15, 2001. These shields are useful to prevent heat transmitted from an engine's high temperature components, such as the exhaust manifold, from reaching and damaging adjacent non-metal components. Examples of operating apparatus having non-metal components in need of protection include alternators, starter motors, turbo chargers, plastic storage containers for water and brake cylinder reservoirs wiring and tubing. These shields are also useful to reduce the transfer of noise and vibrations coming from the engine and various components of the exhaust system, including the manifold.

It is desirable that a heat shield for exhaust systems of internal combustion engines to meet the following criteria:

(a) to provide thermal shielding;

(b) to abate noise;

(c) to abate vibrations;

(d) strength to resist damage;

(e) to protect the engine/manifold from mechanical damage;

(f) recyclable; and (g) easy and inexpensive to manufacture.

Known heat shields for exhaust systems of internal combustion engines include those formed of a single metal layer. Among the disadvantages of such shields are that they do not efficiently reduce noise, they have a tendency to vibrate, and that they are the least effective of all heat shield types in reducing conductive heat transfer. Known heat shields for exhaust systems of internal combustion engines include those formed of two metal layers of either equal or unequal thickness. Such shields tend to be superior in terms of ability to abate transfer of heat, noise and vibrations over shields formed of a single metal layer. However, the present inventor has appreciated that the ability of these shields to abate transfer of heat, noise and vibrations can be further improved.

Known heat shields for exhaust systems of internal combustion engines include those formed of two metal layers of either equal or unequal thickness, and a layer of insulating material (e.g. fiberglass, ceramic, aramid or air) sandwiched between the two metal layers. Such shields are, for example, described in U.S. Pat. Nos. 5,590,524 and 6,231,944. The present inventor has appreciated that such shields suffer from the disadvantages of not being recyclable, and of being relatively costly and inconvenient to manufacture because of the process steps required to include the layer of insulting material. Further, the present inventor has appreciated that the layer of insulating material is susceptible to damage, which is caused by periodic heat shock and vibration loads of the environment and by the moisture it can absorb, thus resulting in the disintegration of the fibers and reducing the serviceable life of such shields.

U.S. Pat. No. 5,590,524 describes a shield comprising two metal layers which have substantially different thicknesses and a layer of insulating material between the two metal layers. This patent is a good illustration of the approach that persons skilled in the art have taken in attempting to improve the thermal, acoustical and vibrational abatement properties of such shields. Persons skilled in the art expect that by providing layers which are different as in having substantially different thicknesses, these two layers would have mismatched resonant frequencies resulting in more efficient damping and absorption of acoustical and vibrational energy. Persons skilled in the art also expect that providing a third layer of insulating material would improve the damping properties of the shield by increasing the friction resisting the relative movement between the two metal sheets. Further, persons skilled in the art also expect that a third layer of insulating material would provide more shielding to thermal transmission by increasing the number of interface surface barriers within the shield. The present inventor has appreciated that surprisingly the use of different layers is not the best approach for producing shields with superior thermal, acoustical and vibrational abatement properties.

SUMMARY OF THE INVENTION

To at least partially overcome the disadvantages of previous heat shields, especially for applications where radiant heat management, damage protection, vibration control, noise emittance, recyclability, and geometrical restrictions are given higher priority than conductive heat management, the present invention provides a heat shield with improved acoustical and/or vibrational abatement properties. The present invention also provides a shield which has strength to resist damage, is recyclable, and is relatively easy and inexpensive to manufacture.

An object of the present invention is to provide a shield with improved thermal abatement properties compared to the previous double-layer metallic heat shields of identical overall thickness and comparable metallic materials.

A further object of the present invention is to provide a shield with improved acoustical abatement properties compared to the previous double-layer metallic heat shields of identical overall thickness and comparable metallic materials.

A further object of the present invention is to provide a shield with improved vibrational abatement properties.

A further object of the present invention is to provide a shield which has strength to resist damage better than any previous heat shield, including the ones with a layer of insulating material.

A further object of the present invention is to provide a shield which is recyclable.

A further object of the present invention is to provide a shield which has a longer serviceable life due to better vibration management.

A further object of the present invention is to provide a shield which has improved corrosion resistance without changing its base material and/or its coating.

A further object of the present invention is to provide a shield which is relatively easy and inexpensive to manufacture.

Accordingly, in one aspect, the present invention provides a heat shield for an exhaust system of an internal combustion engine, comprising three metal layers shaped to conform generally to the shape of a high temperature portion of said exhaust system; said metal layers having substantially the same shape and extending in face-to-face adjacency with one layer positioned between the other two layers; said three metal layers being substantially identical.

Preferably, said three metal layers are substantially identical in being of substantially the same thickness and composition.

Preferably, one of said three metal layers may differ in thickness from the other two metal layers by not greater than 20%, more preferably not greater than 15%, or 10%, or 5%.

Preferably, two of said three metal layers have an identical thickness, and more preferably, all said three metal layers have an identical thickness.

Preferably, each of said metal layers has a thickness of between about 0.25 mm and about 0.5 mm, more preferably between about 0.30 mm and about 0.45 mm, or between about 0.35 mm and about 0.40 mm.

Preferably, each of said metal layers has a thickness of about 0.34 mm.

Preferably, each of said three metal layers comprise the same base metals; or two of said three metal layers comprise the same base metals and the remaining layer comprises material that is an alloy of the material of the other two layers; or each of said three metal layers comprises material that is an alloy of the material in at least one of the other two layers.

Preferably, each of said metal layers comprises materials selected from the group consisting of aluminized steel, aluminum coated steel, aluminum cladded steel, and galvanized steel.

Preferably, said heat shield is manufactured by a process under which said metal layers are compressed together under pressure.

Preferably, each of said metal layers has a non-planar shape.

Preferably, each of said metal layers is deep drawn to a ratio of depth to thickness of from about 5:1 to about 100:1, more preferably from about 10:1 to about 75:1, or from about 15:1 to about 50:1.

Preferably, hems are provided along at least some edges of said heat shield to maintain said metal layers nested together.

Preferably, the exterior surface of said shield is coated with a coating effective to provide corrosion-resistant protection to said shield.

Preferably, the exterior surface of said shield is coated with a coating effective to provide heat reflection.

Preferably, said coating is high temperature resistant.

Preferably, said high temperature portion of said exhaust system is an exhaust manifold.

Preferably, said high temperature portion of said exhaust system is selected from the group consisting of a catalytic converter, a muffler, and an exhaust pipe.

Preferably, the shield is spaced away from the exhaust system by an air gap, with preferably, a significant portion of said air gap being between about 1 mm and about 30 mm, more preferably between about 3 mm and about 15 mm wide.

BRIEF DESCRIPTION OF THE DRAWINGS

Further aspects and advantages will become apparent from the following description taken together with the accompanying drawings in which.

Throughout all the drawings and the disclosure, similar parts are indicated by the same reference numerals.

DESCRIPTION OF PREFERRED EMBODIMENTS

Reference is made to FIGS. 1 to 4 which show a preferred embodiment of the present invention.

Figure 1:
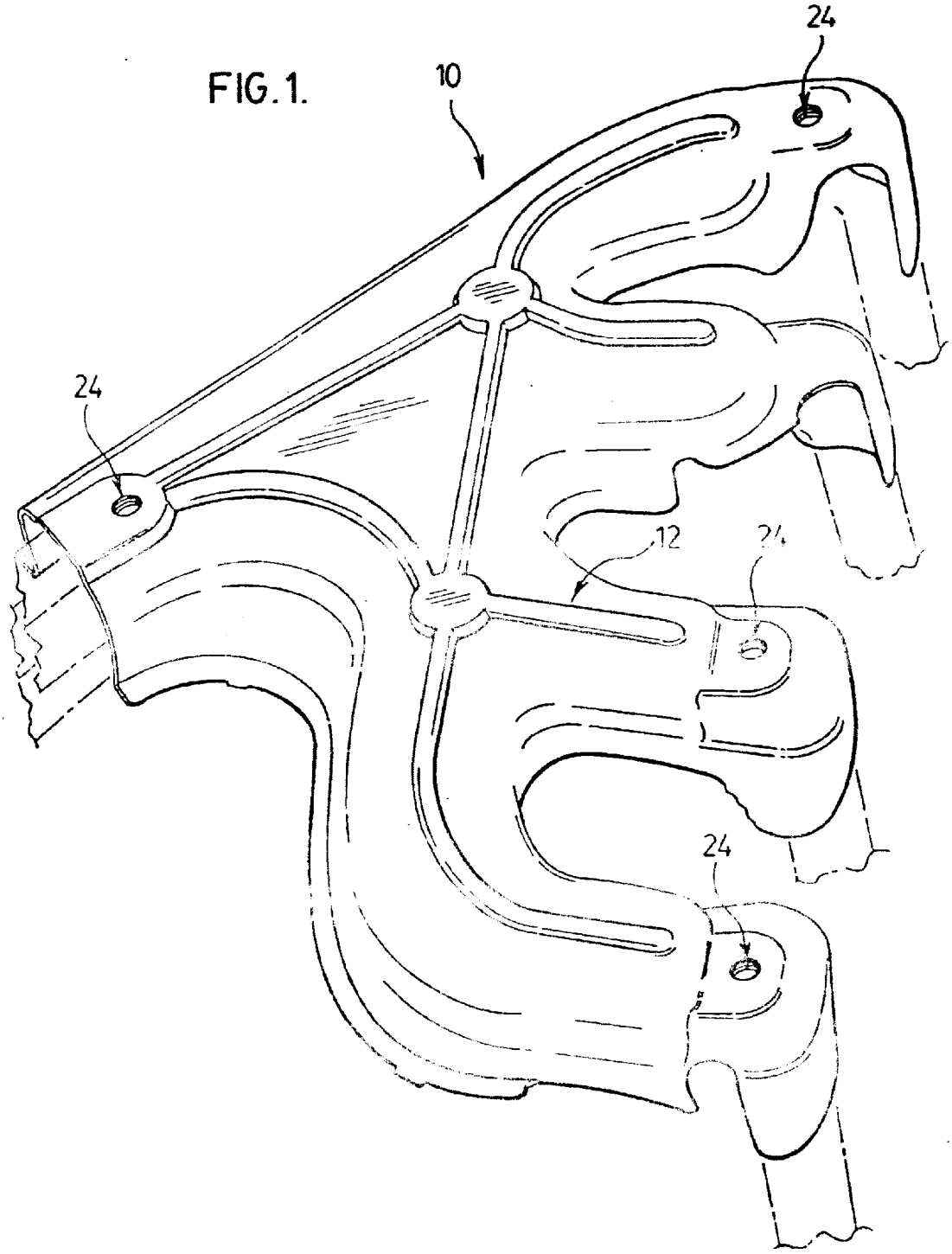
FIG. 1 is a perspective view of a shield in accordance with a preferred embodiment of the present invention.
Figure 3:
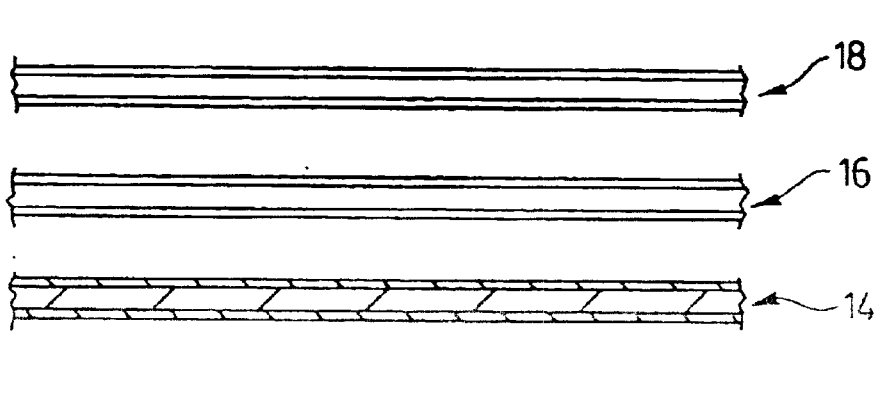
FIG. 3 is an exploded cross-sectional view of the portion identified as 12 in FIG. 1.

As illustrated in FIG. 1, the present invention is a heat shield 10. FIG. 3 illustrates an exploded cross-sectional view of the portion identified as 12 in FIG. 1. As shown in FIG. 3, the shield 10 comprises three metal layers: an inner metal layer 14, a middle metal layer 16, and an outer metal layer 18. All three metal layers 14, 16 and 18 of the preferred embodiment are identical in being of identical thickness and composition.

In the preferred embodiment, each of the three metal layers 14, 16 and 18 has a thickness of between about 0.25 mm to 0.50 mm. The total thickness of the three metal layers 14, 16 and 18 together is between about 0.75 mm and 1.5 mm.

The shield 10 must generally be capable of surviving exposure to extreme temperature conditions caused by heat transmitted from high temperature portions of an exhaust system. For example, shield 10 shown in FIGS. 1 to 4 is intended to be used with an exhaust manifold of an internal combustion engine. An exhaust manifold directly receives exhaust gases, for example at temperatures of about 1550 degrees F., from the engine causing the exterior surface of the exhaust manifold to reach high temperatures, for example of about 1400 degrees F. and the shield 10 to reach temperatures in the range of about 1000 degrees F. In practice, the inner metal layer 14 generally does not exceed 1000 degrees F. to 1200 degrees F. because it is spaced apart from the exhaust manifold by an air gap. Therefore, the shield 10 comprises material that can withstand a temperature of 1000 degrees F., and more preferably 1200 degrees F. without significant degradation.

In the preferred embodiment, all three metal layers 14, 16 and 18 have identical compositions in that they comprise the same base metals. This ensures similar thermal expansion rate in order to avoid building up frictional and compression stress among layers if exposed to heat. Specifically, the three metal layers 14, 16 and 18 of the preferred embodiment are all made from aluminized steel.

Generally, aluminized steel is produced by contacting liquid aluminum with a solid steel surface such as a steel sheet. For example, a steel sheet may be dipped in an aluminum bath. Alternatively, it is believed that vacuum deposition aluminum-coated steel may be used. Vacuum deposition aluminum-coated steel is produced by a process also referred to as vacuum metalizing or aluminum vapor deposition, where aluminum is vaporized, typically by applying an electric arc current to aluminum wire, and the vaporized aluminum is deposited as a thin coat or film on a relatively cool sheet steel substrate in close proximity, in a vacuum environment. In the preferred embodiment, the steel is coated with a thin coating or film of aluminum on both sides of each metal layer.

To manufacture a heat shield in accordance with the preferred embodiment, blanks, consisting of the three metal layers 14, 16 and 18 are obtained from a supply of aluminized steel. The three layers 14, 16 and 18 are positioned relative to one another such that they are in face-to-face adjacency. Preferably, the three layers 14, 16 and 18 are mechanically secured to maintain a unitary assembly by means such as, but not limited to, tabs, hems, rivets or welding along scrap edge portions. The inner metal layer 14, middle metal layer 16 and outer metal layer 18 are then compressed together between two dies and formed into the desired shape in one or several forming stages using an amount of pressure of preferably from about 1200 psi to about 1400 psi. Consequently, all three layers 14, 16 and 18 have the same shape and extend in face-to-face adjacency.

In the preferred embodiment, the shield 10 is to be used with an exhaust manifold of an internal combustion engine. Therefore, the shield 10 is shaped to conform generally to the shape of an exhaust manifold of an internal combustion engine as shown in FIGS. 1 and 2.

Deep drawing techniques are used in the shaping operation to prevent unwanted folds and wrinkles from developing in the metal layers 14, 16 and 18. The inventor has surprisingly and unexpectedly found that it is possible to effectively deep draw the three metal layers 14, 16 and 18 together. The inventor has also found that, by using metal layers of the same thickness and composition, it is easier to deep draw and avoid folds and wrinkles than with metal layers of different thickness and composition. As shown in FIG. 2, the preferred embodiment is deep drawn to a ratio of depth to thickness of from about 15:1, at D1, to about 50:1, at D2.

Figure 2:
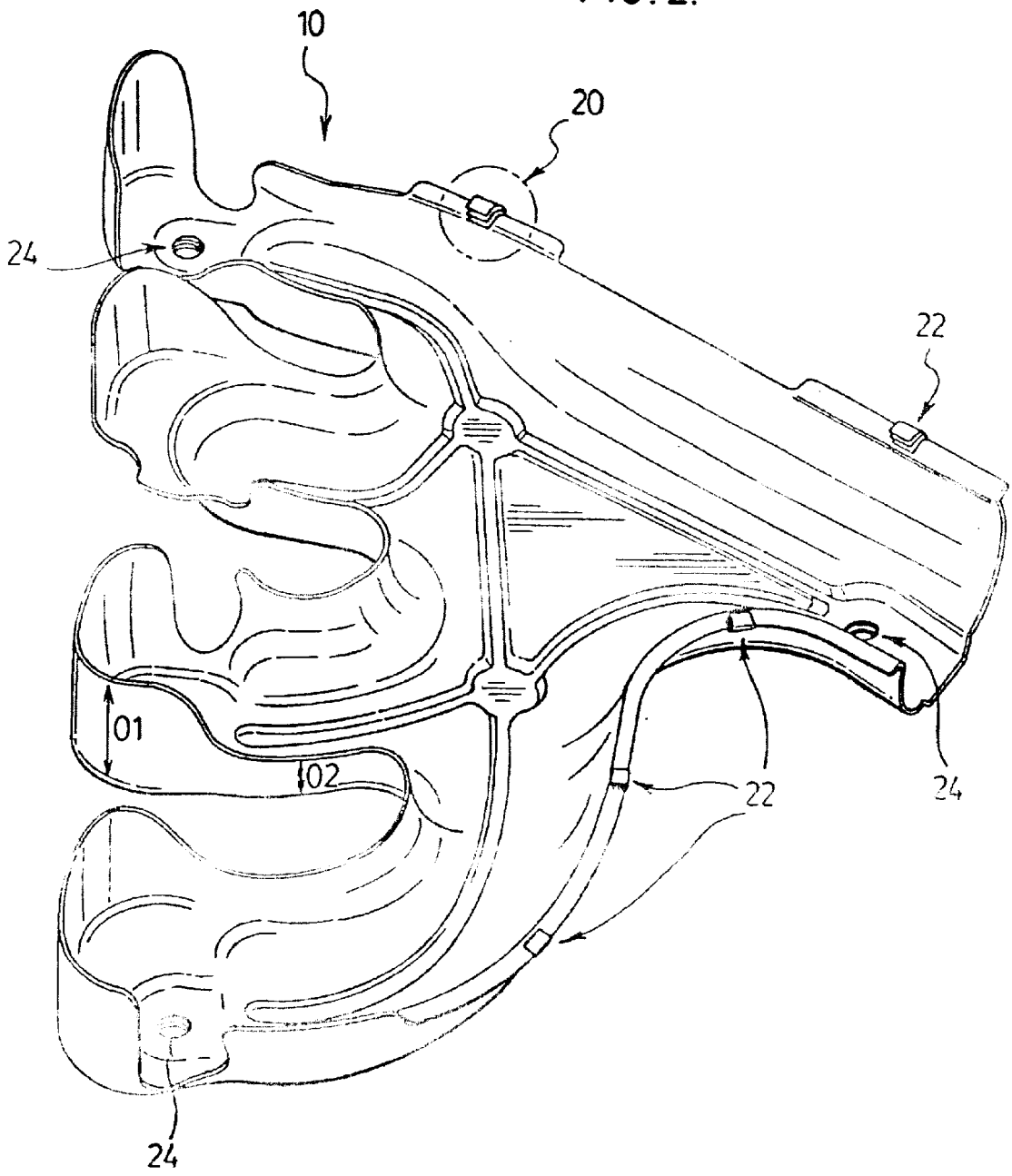
FIG. 2 is an inside view of the shield shown in FIG. 1.
Figure 4:
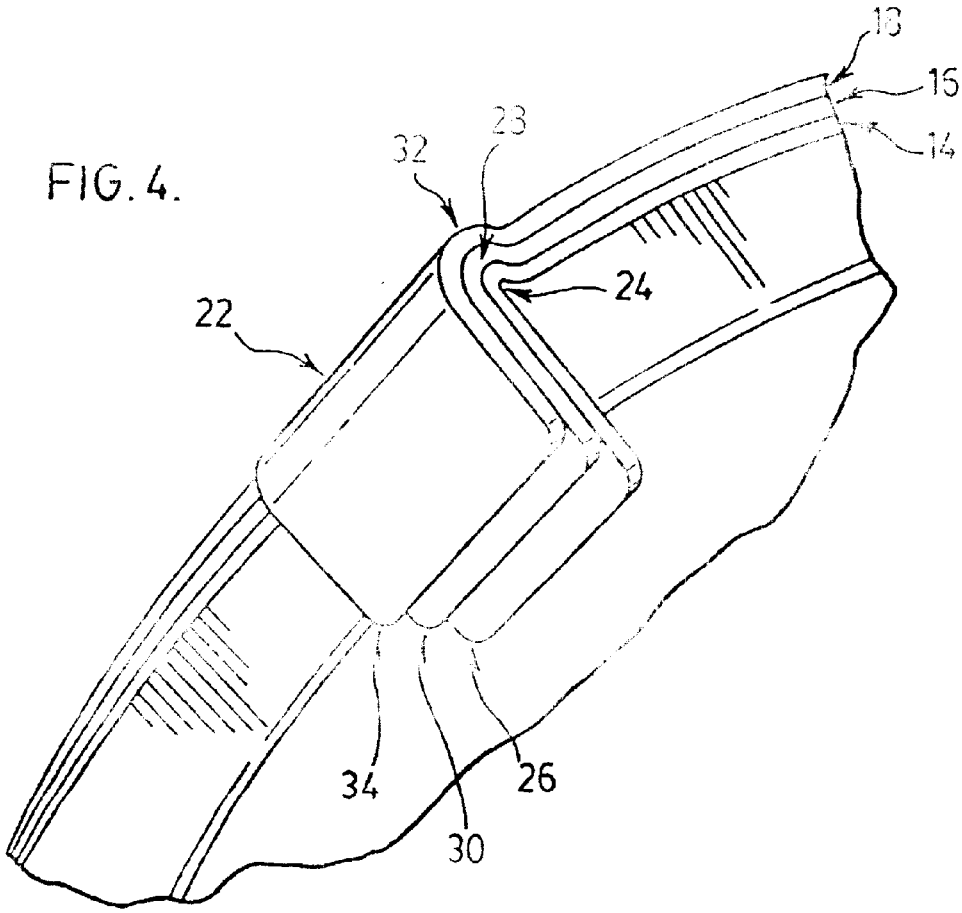
FIG. 4 is an enlarged view of the portion identified as 20 in FIG. 2 illustrating the structural detail at peripheral edge portions of the shield where a hem is formed.

As illustrated in FIG. 2, the edge portions of the shield 10 are provided with hems 22 which maintain the three metal layers 14, 16 and 18 nested together. FIG. 4 is an enlarged view of the portion identified as 20 in FIG. 2 illustrating the structural detail at an edge portion of the shield 10 where a hem 22 is formed. The three metal layers 14, 16 and 18 of the preferred embodiment are nested together such that the peripheral edges of each of the metal layers are conterminous. The inner metal layer 14 is bent back upon itself at 24 to form a reverse bend and extends to a free end at 26. Similarly, the middle metal layer 16 is bent back upon itself at 28 and extends to a free end at 30. Finally, the outer metal layer 18 is bent back upon itself at 32 and extends to a free end at 34.

To help minimize the transmission of thermal and vibrational energy from the high temperature portion of the exhaust system to the shield 10, there is minimal physical contact between them. Preferably, the only points of physical contact are bolts which fix the shield 10 in relation to the high temperature portion of the exhaust system such that an air gap is provided. As shown in FIGS. 1 and 2, holes 24 are provided at various points in the preferred embodiment for use with such bolts. The width of the air gap varies due to manufacturing considerations. Preferably, the air gap is about 1 mm to 30 mm wide, and more preferably, 3 mm to 15 mm wide, or 6 mm to 12 mm wide.

Alternative Embodiments

In alternative embodiments to the preferred embodiment described above, each of the three metal layers 14, 16 and 18 has substantially the same thickness in that one of the three metal layers may differ in thickness from the other two metal layers by not greater than 20%. More preferably, one of the three metal layers may differ in thickness from the other two metal layers by not greater than 15%, or not greater than 10%, or not greater than 5%. Preferably, at least two of the three metal layers have an identical thickness.

Preferably, each of the three metal layers 14, 16 and 18 has a thickness of between about 0.25 mm and about 0.5 mm. More preferably, each of the three metal layers 14, 16 and 18 has a thickness of between about 0.30 mm and about 0.45 mm, still more preferably between about 0.35 mm and about 0.40 mm.

The total thickness of the three metal layers 14, 16 and 18 together will vary depending upon the intended application and can be selected by a person skilled in the art to meet the requirements for thermal, acoustical and/or vibrational abatement.

Preferably, each of the three metal layers 14, 16 and 18 have substantially the same composition in that either:

(a) all three metal layers 14, 16 and 18 comprise the same base metals; or (b) two metal layers comprise the same base metals and the remaining metal layer comprises material that is an alloy of the material of the other two layers; or (c) each of the three metal layers 14, 16, 18 comprises material that is an alloy of the material in at least one of the other two layers.

Preferably, each of the three metal layers 14, 16 and 18 is obtained from the same roll of metal sheeting.

The three metal layers 14, 16 and 18 may be made from a range of materials which can be selected by a person skilled in the art. Preferably, the three metal layers 14, 16 and 18 are made from corrosion-resistant materials. More preferably, the three metal layers 14, 16 and 18 are made from steel or aluminum, and still more preferably from materials selected from the group consisting of aluminized steel, aluminum coated steel, aluminum cladded steel and galvanized steel.

The shape of the shield 10 will vary depending on the environment in which it is intended to be used and can be selected by a person skilled in the art. The three metal layers 14, 16 and 18 are compressed together and formed into the desired shape using conventional tools and techniques known to those skilled in the art. For example, stamping techniques may be used. Consequently, all three layers 14, 16 and 18 have the same shape and extend in face-to-face adjacency.

Deep drawing techniques which are known to those skilled in the art may be used in the shaping operation to prevent unwanted fold and wrinkles from developing in the metal layers 14, 16 and 18. Preferably, the shield 10 is deep drawn to a ratio of depth to thickness of from about 5:1 to about 100:1. More preferably, the shield 10 is deep drawn to a ratio of depth to thickness of from about 10:1 to about 75:1.

In alternative embodiments to the preferred embodiment, the shield 10 may be coated along its exterior surfaces with a high temperature resistant paint-type coating. This coating is applied preferably by dipping the uncoated shield 10 into a bath of the temperature-resistive paint coating to ensure that all exterior surfaces, including the edges, are fully coated. Alternatively, the coating may be applied by spraying. After removing the shield 10 from the bath and allowing excess material to drip off, the coated shield 10 is allowed to dry. Then, to provide a full cure of the coating, the shield 10 is baked, for example, at about 400 degrees F. for one hour. The coating material penetrates into the edge portions between the metal layers 14, 16 and 18 and forms an effective seal to prevent corrosion producing substances from entering into the interior of the shield 10. Similarly, a full seal is formed along the edges of the hems 22. The cured coating is about 0.001 inch thick. Two metal layers are still considered to have substantially the same composition where:

(a) one metal layer has a coating while the other metal layer does not; and (b) one metal layer has a coating that is different in thickness and/or composition from the coating of the other metal layer.

The present inventor has found that, surprisingly, the thermal, acoustical and vibrational abatement properties of such shields are further improved by replacing the layer of insulating material from prior art with a middle metal layer 16 which is substantially identical to the inner metal layer 14 and the outer metal layer 18. By producing a shield 10 with three metal layers 14, 16 and 18 which are substantially identical, the present invention has the following additional enhanced features:

(a) The shield 10 of the present invention has a longer serviceable life than prior art shields which have a layer of insulating material. This is because the layer of insulating material is often more susceptible to damage due to repeated heat shock, vibration and moisture than the metal layers.

(b) The shield 10 of the present invention has better corrosion resistance due to the increased number of corrosion resistant surfaces and encapsulated mill oil films in the material sandwich.

(c) The entire shield 10 of the present invention is recyclable. In contrast, the layer of insulating material in prior art shields is often made from materials, such as fiberglass, silica fiber, ceramic fiber, rock wool, and refractory materials in a blanket or paper form which are not recyclable.

(d) The shield 10 of the present invention is more environmentally friendly to manufacture than prior art shields having a layer of insulating material, because there are no airborne fiber particles present to cause respiratory hazards.

(e) The shield 10 of the present invention is more environmentally friendly to operate and service than prior art shields having a layer of insulating material, because there are no airborne fiber particles can be released from damaged shields.

(f) The shield 10 of the present invention is more environmentally friendly to operate and service than prior art shields having a layer of insulating material, because there are no chemical bonding agents present which, when exposed to service temperatures of the shield, could transform and result in degasing and could also release smoke.

(g) The shield 10 of the present invention is easier and less expensive to manufacture than prior art shields having a layer of insulating material. Manufacturing the above-mentioned prior art shields includes the inconvenience of having to work with more than one type of material and additional process steps required to insert the layer of insulating material between the two metal layers.

(h) The shield 10 of the present invention is easier and less expensive to manufacture than prior art shields which have metal layers of different thicknesses. The metal layers 14, 16 and 18 of the present invention can be cut from the same coil.

The present inventor conducted extensive tests on the thermal, acoustical and vibrational abatement properties of the following types of heat shields:

(a) Various thicknesses of a single metal layer;

(b) Various thicknesses of two metal layers which are identical in thickness;

(c) Various thicknesses of two metal layers which differ in thickness by between 25% and 150%;

(d) Various thicknesses of two layers which differ in thickness and having the thinner layer facing the heat source;

(e) Various thicknesses of two layers which differ in thickness and having the thicker layer facing the heat source;

(f) Two metal layers which are identical in thickness with various types of insulating materials with various layer thicknesses sandwiched between the two metal layers;

(g) Two metal layers which differ in thickness by greater than 25% with a layer of insulating material sandwiched between the two metal layers;

(h) Three metal layers which are each different in thickness;

(i) Three metal layers which have two layers of identical thickness as the exposed layers and a third layer of different thickness as the encapsulated layer;

(j) Three metal layers which are identical in thickness and composition.

Surprisingly, the present inventor found that the heat shield of the present invention has improved acoustical and vibrational abatement properties over the other metallic heat shields.

Although this disclosure has described and illustrated a preferred embodiment of the invention, it is to be understood that the invention is not restricted to this particular embodiment. Rather, the invention includes all embodiments which are functional or mechanical equivalents of the specific embodiment and features that have been described and illustrated herein. Many modifications and variations will now occur to those skilled in the art. For a definition of the invention, reference is made to the following claims.

I claim:

1. In combination, an exhaust system of an internal combustion engine and a rigid, non-corrugated heat shield for an exhaust system of an internal combustion engine, comprising three metal layers having substantially the same shape and extending in face-to-face adjacency with one layer positioned between the other two layers, said shield being spaced away from an exhaust manifold of the exhaust system by an air gap, the improvement comprising:

said three metal layers being formed from three substantially identical metal sheets;

each of said three metal layers having a three-dimensional shape which is substantially identical and conforms generally to the shape of the exhaust manifold; and each of said three metal layers is formed to the three-dimensional shape by deep drawing the three metal layers while sandwiched together to a ratio of depth to thickness of from about 5:1 to about 100:1.

2. A combination according to claim 1, wherein each of said metal layers has a thickness of between about 0.25 mm and about 0.50 mm.

3. A combination according to claim 1, wherein each of said metal layers has a thickness of between about 0.30 mm and about 0.45 mm.

4. A combination according to claim 1, wherein each of said metal layers has a thickness of between about 0.35 mm and about 0.40 mm.

5. A combination according to claim 1, wherein each of said metal layers has a thickness of about 0.34 mm.

6. A combination according to claim 1, wherein said three metal layers together have a total thickness of between about 0.75 mm and about 1.5 mm.

7. A combination according to claim 1, wherein said three metal layers together have a total thickness of between about 0.9 mm and about 1.25 mm.

8. A combination according to claim 1, wherein each of said metal layers is obtained from the same coil.

9. A combination according to claim 1, wherein each of said metal layers comprise a corrosion-resistant material.

10. A combination according to claim 1, wherein each of said metal layers comprises material selected from the group consisting of aluminized steel, aluminum coated steel, aluminum cladded steel and galvanized steel.

11. A combination according to claim 1, wherein said heat shield is manufactured by a process under which said metal layers are compressed together under pressure.

12. A combination according to claim 1, wherein each of said metal layers has a non-planar shape.

13. A combination according to claim 1, wherein hems are provided along at least some edges of said heat shield to maintain said metal layers nested together.

14. A combination according to claim 1, wherein the exterior surface of said shield is coated with a coating effective to provide corrosion-resistant protection to said shield.

15. A combination according to claim 1, wherein said air gap is between about 1 mm and about 30 mm wide.

* * * * *